United States Patent [19]

Smith

[11] Patent Number: 5,063,696

[45] Date of Patent: Nov. 12, 1991

[54] EXCAVATOR BUCKET TOOTH RETENTION DEVICE

[75] Inventor: Kelly M. Smith, Gillette, Wyo.

[73] Assignee: Atlantic Richfield Company, Los Angeles, Calif.

[21] Appl. No.: 655,009

[22] Filed: Feb. 13, 1991

[51] Int. Cl.[5] ..... E02F 9/28

[52] U.S. Cl. ..... 37/141 T; 37/142 A

[58] Field of Search ..... 37/142 A, 142 R, 141 T, 37/141 R

[56] References Cited

U.S. PATENT DOCUMENTS

| | | | |
|---|---|---|---|
| 1,118,726 | 11/1914 | Beecher . | |
| 1,652,059 | 12/1927 | Skinner . | |
| 2,635,366 | 4/1953 | Hostetter | 37/142 A |
| 4,182,058 | 1/1980 | Poncin | 37/142 A |
| 4,187,035 | 2/1980 | Colburn | 37/142 A X |
| 4,663,867 | 5/1987 | Hahn et al. | 37/142 A |

*Primary Examiner*—Dennis L. Taylor
*Assistant Examiner*—J. Russell McBee
*Attorney, Agent, or Firm*—Michael E. Martin

[57] ABSTRACT

Digging teeth and support adapters for excavating buckets and the like are retained connected to the lip portion of the bucket in the event of failure of a tooth, its adapter or any device which normally secures the tooth and the adapter to the bucket lip by an elongated, flexible cable trained through a passage in the bucket lip, a passage in the adapter and secured to the tooth. Retainer fittings on the cable engage cooperating retainer parts on the tooth and the lip portion to prevent loss of the tooth due to such failure.

11 Claims, 3 Drawing Sheets

EXCAVATOR BUCKET TOOTH RETENTION DEVICE

BACKGROUND OF THE INVENTION

1. Field of the Invention

The present invention pertains to a device for retaining a broken or detached excavator bucket tooth connected to the bucket to prevent loss of the tooth or tooth adapter into the material being excavated.

2. Background

In excavating certain mineral values such as coal and other useful materials, the loss of certain parts of the excavating equipment such as the detachable excavating bucket teeth into the excavated material can cause severe operational problems with the material processing equipment. For example, in the excavation of coal, the hard metal excavator bucket tooth and/or tooth adapter, if lost into the coal during excavation, can severely damage the coal crushing and processing equipment.

U.S. Pat. Nos. 1,118,756 to Beecher and 1,652,059 to Skinner disclose combination rod and taut cable mechanisms to prevent the loss of well drilling tools. However, there has been a long, unfulfilled need to provide suitable means for preventing loss of the excavating teeth and adapter members for said teeth, which are arranged along the leading edge of excavating buckets and the like and, in particular, means which will prevent loss of a tooth and/or adapter while alerting the machine operator that the tooth and/or adapter has failed. The present invention provides a unique solution to this need.

SUMMARY OF THE INVENTION

The present invention provides a unique tooth retention device for preventing the loss of digging teeth and support adapter members therefor used on excavating buckets and the like.

In accordance with an important aspect of the present invention, a flexible cable member is connected between the bucket leading edge or lip and a digging tooth supported on the bucket to prevent loss of the tooth and its adapter into the excavated material in the event that the tooth support member or adapter fails or the tooth otherwise becomes dislodged from its normal position. In accordance with another important aspect of the present invention, there is provided a flexible cable-type retaining device for an excavator tooth which is disposed protected from wear and abrasion during normal operation of the excavating tooth and bucket arrangement. The retaining device of the present invention may be adapted to new or to existing excavating bucket and tooth structures.

Still further in accordance with the present invention, there is provided a retention device for retaining an excavating bucket tooth and a tooth support or adapter member connected to the bucket structure but loosely held thereby so as to be recognized as having failed in the event that one or both members fails or separates from the bucket itself during operation.

Those skilled in the art will recognize at least some of the advantages and superior features of the present invention, together with other important aspects thereof, upon reading the detailed description which follows in conjunction with the drawing.

DESCRIPTION OF PREFERRED EMBODIMENTS

Figure 1:
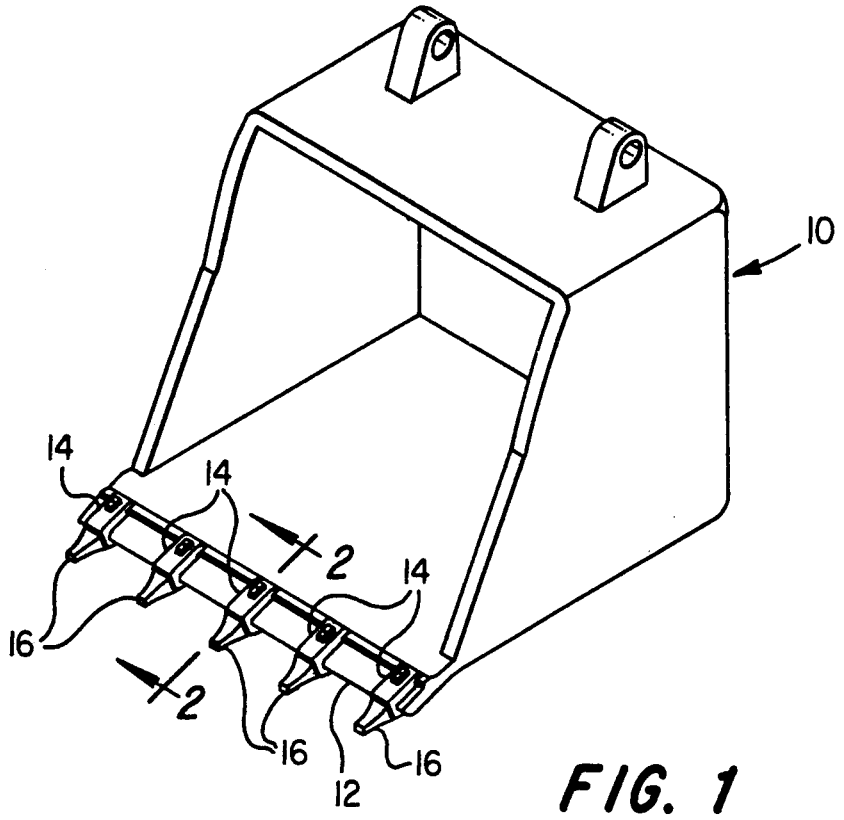
FIG. 1 is a perspective view of an excavating bucket showing a conventional arrangement of digging teeth and support or adapter members therefor.

In the description which follows, like parts are marked throughout the specification and drawing with the same reference numerals, respectively. The drawing figures are not necessarily to scale in the interest of clarity and conciseness.

Referring to FIG. 1, there is illustrated a typical excavating bucket, generally designated by the numeral 10. The bucket 10 is adapted to be attached to the arm of an excavating machine, not shown, such as a power shovel or backhoe, or to the hoist line of a dragline. The bucket 10 has a forward edge or lip 12 on which is mounted a plurality of spaced-apart parallel extending support members or adapters 14 for supporting, respective digging teeth 16. In conventional practice, the adapters or support members 14 are secured to the lip 12 of the bucket 10 by welding, by suitable clamp means, pins or other devices. In like manner, the teeth 16 are typically removably supported on the adapter members 14 by wedges, pins or other suitable means so that the teeth may be replaced when broken or worn. However, if the teeth 16 inadvertently break off or become disconnected from the adapter members 14, they may, of course, be lost in the material being excavated and conveyed with that material to processing equipment resulting in severe damage to such equipment due to the hardness and strength of the teeth or the adapter members themselves.

Figure 2:
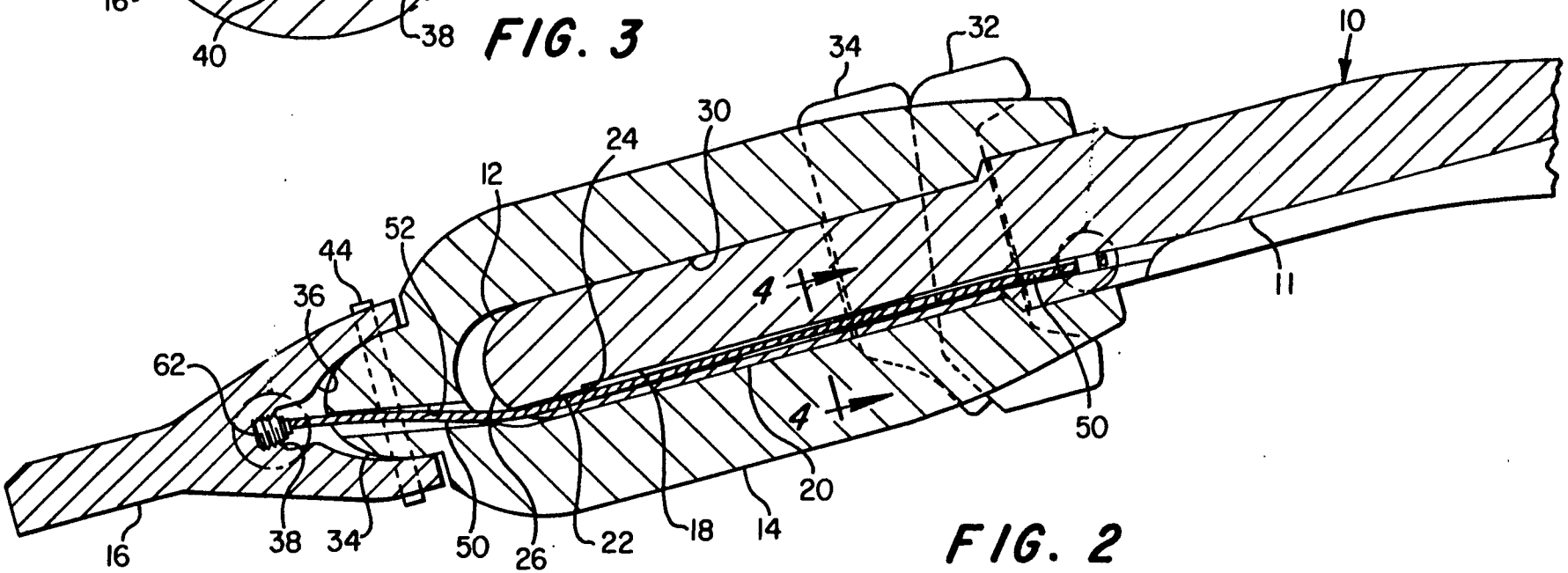
FIG. 2 is a section view taken generally along the line 2—2 of FIG. 1.

An exemplary arrangement according to the present invention is further illustrated in FIGS. 2 through 5. Referring to FIG. 2, the leading edge or lip 12 of the bucket 10 has been modified to include an elongated trough or bore 18 extending generally along the bottom edge thereof; see FIG. 4 also. The bore 18 extends from a recess 11 in the bottom side of the lip 12 to the distal end thereof and is closed over part of its length by a plate member 20 which is suitably welded in place along the bottom surface 21 of the lip 12. The trough or bore 18 has a reduced cross sectional area passage portion 22, delimited by a transverse shoulder 24, see FIG. 2. The reduced passage 22 opens to the distal end 26 of the lip 12. Those skilled in the art will recognize that the trough 18 may be machined as a bore in the lip 12, thereby not requiring the cover plate 20, or machined or cast in place initially and then covered by the cover plate. Alternatively, the bore or trough 18 may be formed along the upper surface of the lip 12.

As shown in FIG. 2, the adapter 14 includes an elongated slot 30 formed therein for disposing the adapter over the lip 12. In the exemplary arrangement shown in FIG. 2, the adapter 14 is removable from the lip 12 and is secured to the lip by a generally C-shaped clamp member 32 which extends through corresponding slots formed in the adapter 14 and the lip 12 in a conventional manner. A wedge member 34 is also secured in the aforementioned slots in forcible engagement with the clamp 32 to retain the adapter 14 on the lip 12. Other arrangements for securing adapters or similar support members for excavator teeth are known in the art, including forming the adapter as a cast-in part of the bucket bottom wall or lip, welding the adapter to the lip or using other fastener means for securing the adapter to the lip or leading edge of the excavating bucket.

The adapter 14 includes a forward projecting boss 34 for supporting a digging tooth 16 thereon. The boss 34 fits into a conforming socket 36 in the tooth 16, which socket includes a recess 38 having an internally-threaded portion 40, see FIG. 3 also. As shown in FIG. 2, the tooth 16 is secured to the boss 34 by a suitable tapered pin or wedge-shaped key 44 extending through suitable passage means formed in the tooth 16 and the boss 34, respectively.

Figure 4:
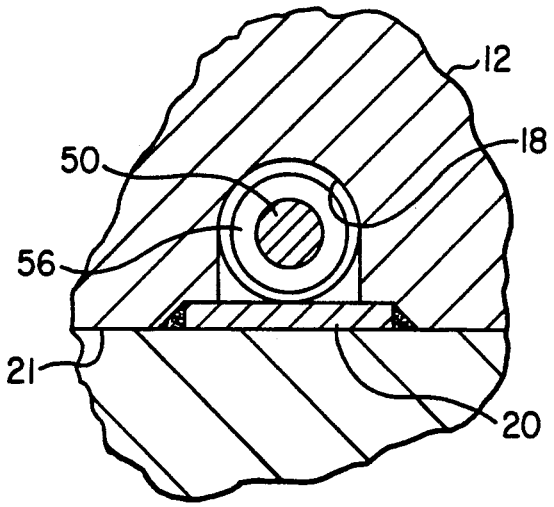
FIG. 4 is a detail section view taken along the line 4—4 of FIG. 2.
Figure 5:
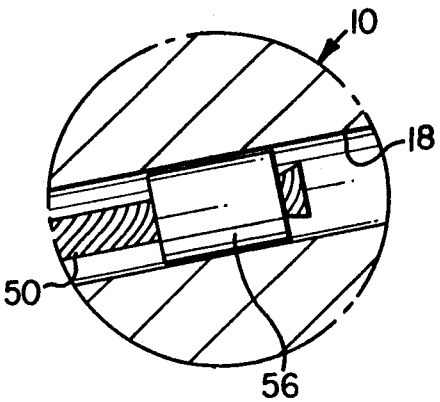
FIG. 5 is a detail view of the other end of the cable arrangement of FIG. 2.
Figure 3:
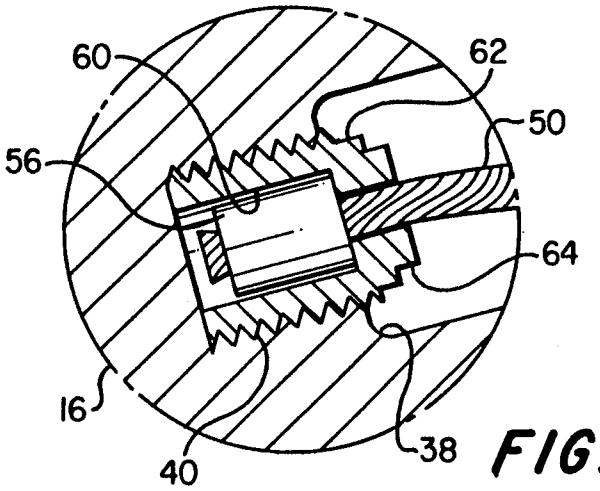
FIG. 3 is a detail view showing one end of the retention cable.

As shown in FIGS. 2 through 5, an elongated, flexible retaining cable 50 extends from the recess 38 through a cooperating bore 52 formed in the boss 34 and opening into the recess 30, then through the reduced cross section passage 22 of the trough 18 and through the trough 18 itself. Each end of the cable 50, as shown in FIGS. 4 and 5, is provided with a retaining fitting 56 which is a conventional swaged sleeve or "becket" suitably secured to the cable in a conventional manner. As shown in FIG. 3, the fitting 56 is disposed in a recess 60 formed in a retainer nut 62 which is threaded into the threaded portion 40 of the recess 38. The retainer 62 includes a suitable end portion formed to have wrench flats or the like 64 to provide for threading the retainer 62 securely into position as illustrated. The fitting 56 is of a diameter large enough that it will not exit the trough 18 through the reduced cross sectional area passage 22 but will engage the shoulder 24 to retain the cable 50 secured to the lip 12. Accordingly, if the tooth 16 should in some way disengage from or break off of the boss 34, the cable 50 will retain the tooth 16 connected to the bucket 10 loosely hanging therefrom, which condition may be easily detected by the operator of the excavating equipment to which the bucket 10 is attached. In like manner, if the adapter 14 should break or come loose from the lip 12 in assembly with the tooth 16, the cable 50 will also prevent complete loss of the adapter and tooth assembly in the same manner as if the tooth alone became detached from the adapter. The cable 50 should also be long enough so that the tooth 16, when separated from the adapter 14, will dangle or trail under the bucket 10 a short distance to minimize tension on the cable and provide for easy visual inspection of the condition by the operator of the excavator. The cable 50 must, of course, be of sufficient strength to resist impact loading occurring thereto as a result of the tooth 16 or adapter 14 being dislodged from the bucket lip during operation.

In assembling the tooth and adapter retainer cable 50 to the bucket lip 12, one preferred method would be to leave one end of the cable free of its retainer fitting 56 so that, for example, the cable could be inserted into the trough 18 sufficiently to exit the trough adjacent to the recess 11 whereupon a fitting 56 could be applied to the end of the cable. The cable 50 could then be pulled back into the trough 18 until engagement of the shoulder 24, leaving enough length of cable to be threaded through the bore 52 and through the recess in the retainer nut 62 for installation of the second fitting 56 on that end of the cable. The adapter 14 could then be secured to the lip 12, if it is of the removable type, and the retainer 62 then threaded into the recess 38 and tightened. The tooth 16 would then be assembled to the boss 34 of the adapter 14 and secured thereto in a conventional manner. During this last-mentioned operation, the cable 50 would be pushed back into the trough 18 to the position illustrated in FIG. 2.

The present invention also contemplates an arrangement wherein a retaining cable such as the cable 50 may be used to retain a tooth 16 in arrangements wherein the lip 12 or adapter 14 may not be formed to have a groove, trough or bore such as the trough 18 formed therein. For example, the lip 12 and the adapter 14 may have a cable passage formed on the exterior thereof by an enclosure formed by an elongated half-section of tube welded to the exterior bottom surface of the lip 12 and adapter 14, for example, and wherein the passage 52 would be modified to communicate with the welded on tube. In this way, the cable 50 would be retained in the tube and protected against abrasion and wear from use of the bucket 10 in its normal operating mode. A fitting stop surface would be provided at the point of communication between that part of the tube on the adapter 14 and the tube part on the lip 12. Alternatively, the trough or groove 18 could be formed in the top or opposite surface of the bucket lip 12, which would be more accessible for the modification of relatively large heavy buckets.

Figure 6:
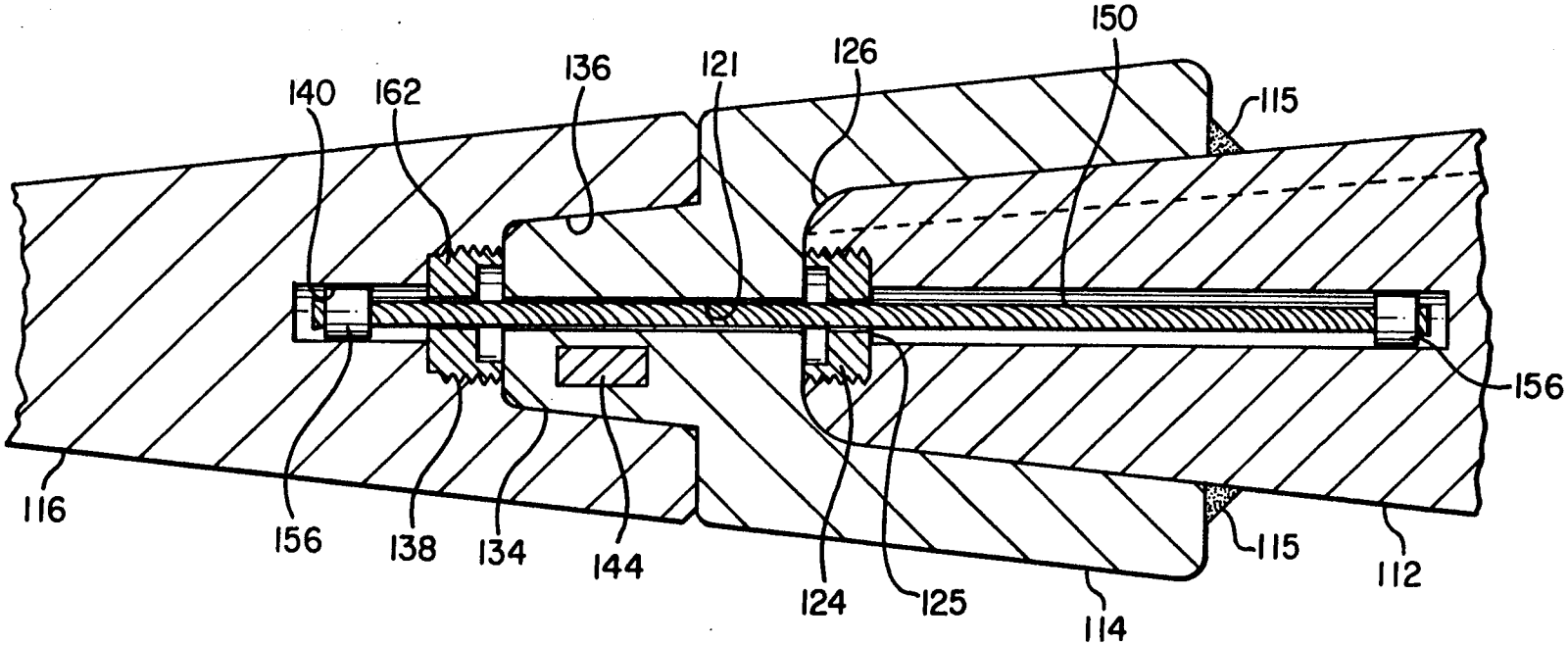
FIG. 6 is a section view similar to that of FIG. 2 showing an alternate embodiment of the present invention.

Referring now to FIG. 6, an alternate embodiment of the present invention is illustrated wherein a modified bucket leading edge or lip 112 has a distal end 126 into which a bore 118 extends. A retention cable 150 is disposed in the bore 118 and is retained in the bore by a threaded retainer 124 threadedly engaged with a threaded recess formed in the distal end 126, as illustrated. The retainer 124 forms a traverse shoulder 125 to allow movement of the cable 150 within the bore 118 but to prevent complete ejection of the cable from the bore when the fitting 156 engages the shoulder or surface !25. A tooth adapter 114 is shown assembled over the distal end of the bucket lip 112 and is secured thereto as by welding at 115, for example. The adapter 114 includes a forward projecting boss 134 which fits within a conforming socket 136 formed in a digging tooth 116. The socket 136 includes a reduced diameter threaded recess 138 in which a cable retainer member 162 is threadedly received. An extension of the recess 138 is indicated by the numeral 140 to provide space for the other end of the cable 150 and for a fitting 156 secured thereto. Accordingly, a length of cable 150 extends from the recess 140 through a suitable bore in the retainer 162, a passage 121 in the adapter 114, a bore in the retainer 124 and into the bore 118. The tooth 116 is suitably secured to the adapter 114 by a conventional key or pin 144. In the event that the key or pin 144 should become dislodged or the tooth 116 otherwise separate from the adapter 114, or if the adapter 114 itself should break free from the lip 112, the cable 150 would prevent complete loss of the tooth and/or the adapter into the material being excavated.

The embodiment illustrated in FIG. 6 may be assembled generally along the lines of the method described for the embodiment of FIG. 2. The cable 150 would be made up with a fitting 156 connected to one end, for example, and the opposite cable end would be threaded through the bore in the fitting 124. The "becketed" cable end with fitting 156 already attached would be inserted in the passage 118 while the fitting 124 is suitably secured in the threaded recess in the distal end 126 of the bucket lip. The cable 150 is of sufficient length that it could then be threaded through the adapter 114 while the adapter is then mounted on the lip 112 and secured thereto, whereupon a sufficient length of cable would be available to slip the retainer 162 thereover, attach the other fitting 156 to the other end of the cable and then insert that end into the recess 140 while threadedly connecting the retainer 162 to the tooth 116. The tooth 116 is then assembled to the adapter and secured thereto by the key 144.

Conventional engineering materials and manufacturing practices may be used in carrying out the present invention. Although preferred embodiments have been described herein, those skilled in the art will recognize that various substitutions and modifications may be made without departing from the scope and spirit of the invention as recited in the appended claims.

What is claimed is:

1. In an excavator bucket having a lip portion, at least one digging tooth secured to said lip portion and means for securing said digging tooth on said lip portion, means for retaining said tooth loosely connected to said lip portion, said means for retaining including a passage formed in said lip portion, recess means in said tooth, an elongated, flexible cable including a fitting at substantially opposite ends of said cable, respectively, and retaining means on each of said lip portion and said tooth for engagement with said fittings, respectively, to retain said tooth loosely connected to said lip portion in the event of failure of said securing means.

2. The invention set forth in claim 1 wherein:

said passage includes means forming a surface for engagement with one of said fittings for retaining one end of said cable attached to said lip portion.

3. The invention set forth in claim 2 wherein:

said passage is formed as a channel in said lip portion, said channel including closure means for closing one side of said channel longitudinally therealong.

4. The invention set forth in claim 2 wherein:

said surface is disposed in said passage at a point such that when said tooth is assembled on said lip portion, a predetermined length of slack cable is provided between said fitting and said surface.

5. The invention set forth in claim 1 including:

tooth adapter means supported by said lip portion, said adapter means including passage means formed therein for disposition of a portion of said cable between said retaining means, respectively.

6. The invention set forth in claim 1 wherein:

one of said retaining means includes a threaded member threadedly connected to one of said tooth and said lip portion.

7. The invention set forth in claim 6 wherein:

each of said retaining means comprises a threaded member, one of said threaded members being threadedly connected to said tooth and the other of said threaded members being threadedly connected to said lip portion, respectively.

8. In an excavator bucket having a lip portion, at least one digging tooth secured to said lip portion and means for securing said tooth on said lip portion, means for retaining said tooth loosely connected to said lip portion, said means for retaining including a passage formed in said lip portion, recess means in said tooth, an elongated, flexible cable and retaining means on each of said lip portion and said tooth, respectively, to retain said tooth loosely connected to said lip portion in the event of failure of said means for securing, said retaining means being disposed such that when said tooth is assembled on said lip portion, a predetermined length of slack cable is provided between at least one end of said cable and one of said retaining means.

9. The invention set forth in claim 8 including:

tooth adapter means supported by said lip portion, said adapter means including passage means formed therein for disposition of a portion of said cable between said retaining means, respectively.

10. The invention set forth in claim 8 wherein:

one of said retaining means includes a threaded member threadedly connected to one of said tooth and said lip portion.

11. The invention set forth in claim 10 wherein:

each of said retaining means comprises a threaded member, one of said threaded members being threadedly connected to said tooth and the other of said threaded members being threadedly connected to said lip portion, respectively.

* * * * *